United States Patent [19]

Saotome

[11] 3,991,422

[45] Nov. 16, 1976

[54] DEFENSIVE COVERING FOR THE HEAD

[76] Inventor: Hikogi Saotome, 7-13, 2-chome, Higashi-kokubun, Ichikawa, Chiba, Japan

[22] Filed: Sept. 3, 1975

[21] Appl. No.: 610,005

[30] Foreign Application Priority Data

| | | |
|---|---|---|
| Apr. 21, 1975 | Japan | 50-54420[U] |
| May 22, 1975 | Japan | 50-69160[U] |
| July 24, 1975 | Japan | 50-102682[U] |

[52] U.S. Cl. ..... 2/410

[51] Int. Cl.[2] ..... A42B 1/08

[58] Field of Search ..... 2/3 R, 6, 8

[56] References Cited

UNITED STATES PATENTS

| | | | |
|---|---|---|---|
| 2,578,171 | 12/1951 | Bub | 2/8 |
| 2,861,274 | 11/1958 | Stuart et al. | 2/6 |
| 3,026,525 | 3/1962 | Gyorfy | 2/8 |
| 3,514,787 | 6/1970 | Kennedy | 2/3 R |
| 3,579,637 | 5/1971 | Aileo | 2/3 R |
| 3,665,514 | 5/1972 | Durand | 2/3 R |

FOREIGN PATENTS OR APPLICATIONS

| | | | |
|---|---|---|---|
| 975,576 | 11/1964 | United Kingdom | 2/3 R |

*Primary Examiner*—Alfred R. Guest

*Attorney, Agent, or Firm*—Wenderoth, Lind & Ponack

[57] ABSTRACT

A defensive covering for the head comprising a plurality of arc-shaped rigid straps made of light metals or synthetic resin, and a pivot or pivots axially connecting an end or ends of the straps so that the straps are collapsible and expansible about the pivot(s). A bowl shaped defensive covering for the head is, thereby, formed by expansivelly pivoting the straps about the pivot(s).

5 Claims, 16 Drawing Figures

DEFENSIVE COVERING FOR THE HEAD

BACKGROUND OF THE INVENTION

The present invention relates to a defensive covering for the head, hereinafter described as a helmet, used particulary by those who are engaged in hazardous occupations or sports.

Helmets are usually thought of today as items of military requirement for soldiers, sailors or airmen, but modified types are widely worn by firemen, miners, construction workers, race drivers and others engaged in hazardous occupations or sports.

Conventionally, helmets made of a single bowl-shaped or hemispherical member have been widely used. However, these conventional helmets are bulky because the helmet is formed with a single bowl shaped member and is not collapsible to a compact form, which is ackward particularly for carrying and storing while the helmets are not used.

Despite the fact that every family, as well as every motorcycle driver, has been required to possess a helmet as a precaution against contingencies as earth quakes or other disasters and traffic accidents, diffusion of helmets among families and drivers has not yet been satisfied. It is believed that this is due to the fact that the conventional helmets are too bulky to be carried and stored.

Accordingly, an object of the present invention is to provide a new helmet which is collapsible to a compact form.

Another object of the present invention is to provide a helmet which is light weight and satisfies the security requirement as well as the conventional helmets.

DESCRIPTION OF THE DRAWINGS

Like reference numerals represent like parts in the different views of the drawings.

DETAILED DESCRIPTION OF THE INVENTION

Figure 1:
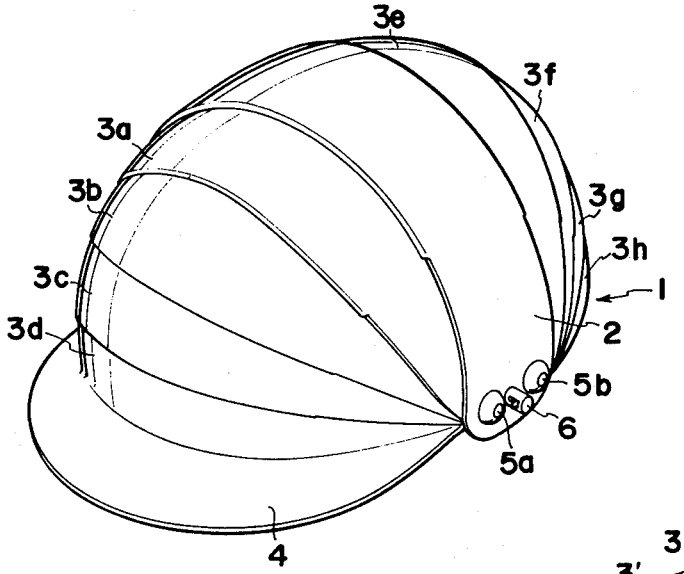
FIG. 1 is a perspective view of a helmet with a brim according to a first embodiment of the present invention.

Referring to FIGS. 1 through 4, a helmet 1 comprises an arc-shaped central strap 2, a plurality of arc-shaped slidable straps 3, and a brim 4. The central strap 2 has substantially the same width along the entire length thereof, while each of the slidable straps 3 has the width which gradually becomes narrower from the top center thereof toward both lower end portions thereof. These straps and brim are made of light rigid material such as light-metal like aluminium alloy plate, or fiber reinforced plastics, etc. The slidable straps 3 may be divided into a first group of straps 3*a*–3*d* in front of the central strap 2 and a second group of straps 3*e*–3*h* behind the central strap 2. The first group of the straps 3*a*–3*d* and the brim 4 are pivotably connected to the central strap 2 by pins 5*a*–5*a*, while the second group of slidable straps 3*e*–3*h* are pivoted to the central strap 2 by pins 5*b*–5*b*. The arcshaped slidable straps 3*a*–3*d* in the first group have radii of curvatures which become smaller in that order and therefore the strap having the smaller radius of curvature is pivoted inside of the strap having a larger radius of curvature by the pins 5*a*–5*a*. Likewise, the arc-shaped slidable straps 3*e*–3*h* in the second group have radii of curvatures which become smaller in that order and therefore the strap having the smaller radius of curvature is pivoted inside of the strap having a larger radius of curvature by the pin 5*b*–5*b*. The arc-shaped central strap 2 has a radius of curvature slightly larger than those of the straps 3*a* and 3*e* and a width of about twice as much as those of the slidable straps 3*a*–3*h*.

Figure 2:
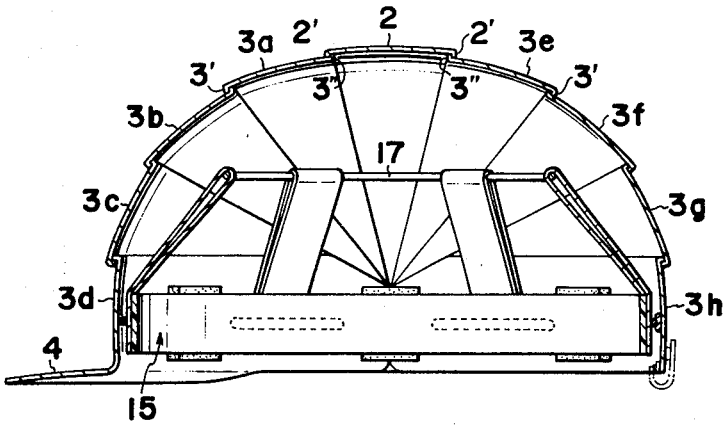
FIG. 2 is a sectioned view of the helmet shown in FIG. 1.

As shown in FIG. 2, the center strap 2 has downward projections 2′—2′ at both the front and back sides thereof. The slidable straps 3*a*–3*c* of the first group each has a downward projection 3′ along the front side thereof and an upward projection 3″ along the back side thereof, while the straps 3*e*–3*g* of the second group each has an upward projection 3″ along the front side thereof and a downward projection 3′ along the back side thereof. The remaining straps 3*d* and 3*h*, which form the lower end portion of the helmet, have the upward projection 3″ along the back side and the front side, respectively.

Figure 4:
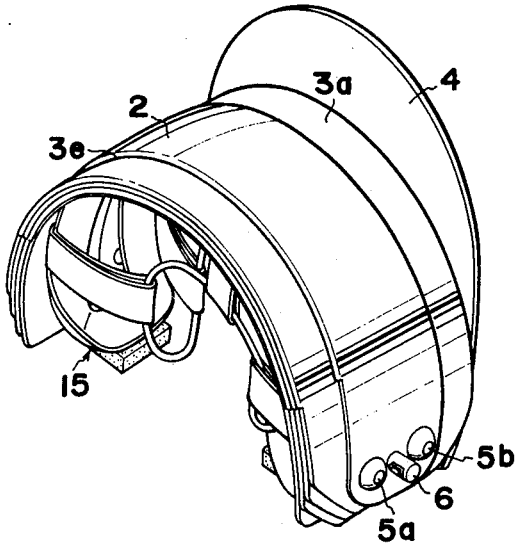
FIG. 4 is a perspective view of the helmet of the first embodiment, showing that the helmet as collapsed into a compact form.

In such an arrangement of the straps 2 and 3*a*–3*h*, the helmet is in the stretched position as shown in FIGS. 1 and 2 and can be collapsed as shown in FIG. 4 since the straps in each of the groups have different radii of curvatures and the strap having the smaller radius of curvature can enter inside of the adjacent strap having a larger radius of curvature. In order to form the helmet in the shape of FIGS. 1 and 2 from the shape in FIG. 4, one may only stretch the innermost straps 3*d* and 3*h* outwardly, because the other straps 3*a*–3*c* and 3*e*–3*g* are pulled out by the engagement of the upward and downward projections 3′ and 3″.

Although the brim 4 is integrally formed with the strip 3*d* in the embodiment shown in FIGS. 1 through 4, it may be separatively formed or omitted as desired.

In order that the slidable straps extended as shown in FIGS. 1 and 2 may keep the position, the helmet has a stopper device 6 between the pins 5*a* and 5*b* on both end portion of the central strap 2, as well shown in FIGS. 4, 5*a*, 5*b* and 5*c*. Construction of the stopper device will be described below in detail.

Figure 5A:
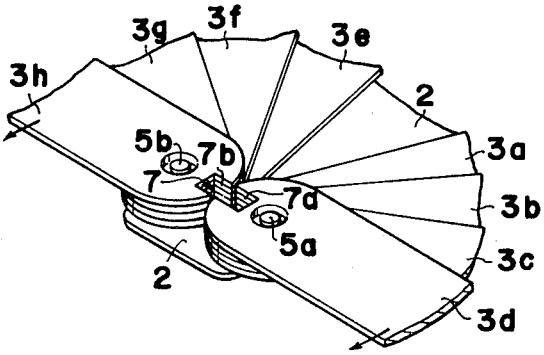
FIG. 5*a*, 5*b* and 5*c* show the detailed construction of a stopper device disposed at both sides of the helmet shown in FIG. 1.
Figure 5C:
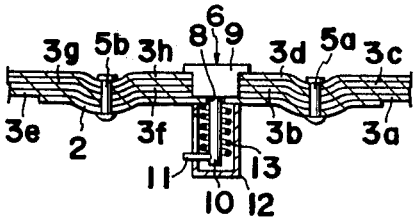

In FIGS. 5*a* and 5*c*, the central strap 2 has an aperture 8 for a rod member of the stopper device 6, which rod will be described below, between the pins 5*a* and 5*b* at the both ends thereof. The straps 3*a*–3*d* in the first group have a respective concave 7*a* adjacent to the aperture 8 of the central strap 2 whereas the other central straps 3*e*–3*h* in the second group have a respective concave 7*b* adjacent to the aperture 8 so that both types of the concaves 7*a* and 7*b* will form a rectangular through-hole 7 when each of the straps is pulled out and pivoted about the respective pin 5*a* or 5*b* in the clockwise and counterclockwise directions as shown by arrows in FIG. 5*a*. The axial center of the aperture 8 is subtantially aligned with the center of the through-hole 7 which is formed by the pulling or unfolding operation of the straps 3*a*–3*f* as described.

Figure 5B:
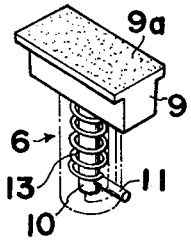
Figure 6A:
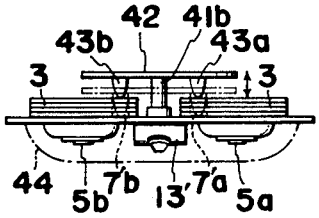
FIG. 6*a* through 6*d* show another embodiment of a stopper used in a helmet of the present invention.
Figure 6B:
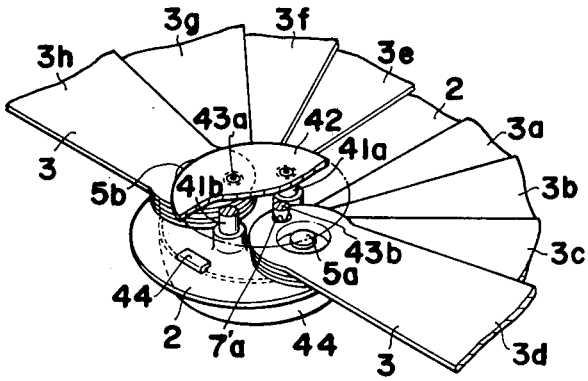
Figure 6C:
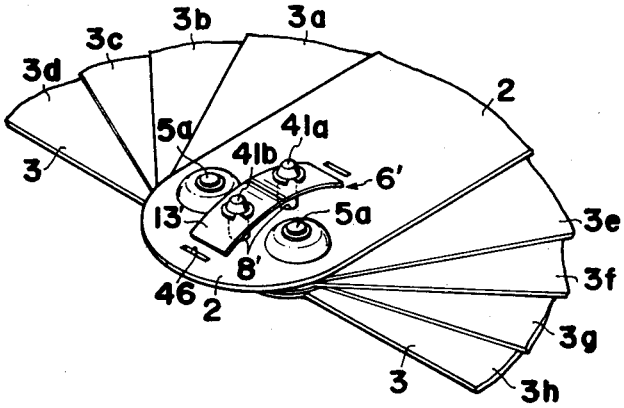
Figure 6D:
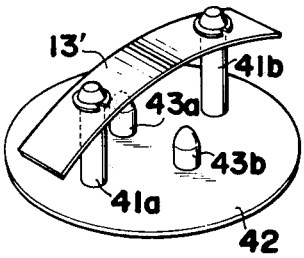

The stopper device 6, as shown in FIG. 5*b*, has a rectangular body 9, a rod member 10 which is vertically extends from the bottom of the body 9 and is turnable about its axis, a lever member 11 laterally extending from the end portion of the rod member 10, and a coiled spring 13 disposed around the rod member 10 between the bottom of the rectangular body 9 and the lever member 11. The rectangular body 9 is so formed that it will be fitted in the rectangular through hole 7 formed by the oval straps 3*a*–3*h*. In other words, the rectangular body 9 has four sides slightly smaller in dimension than the four sides of the rectangular through-hole 7 so that the body 9 may be snugly fitted within the through-hole 7. The rectangular body 9 has an integrally formed upper plate 9*a* which has two sides larger than the shorter sides of the rectangular through-hole 7 so that the rectangular body 9 may not objectionably lie below the plane of the innermost straps 3*c* and 3*f*. However, the upper plate 9*a* may be deleted if the rectangular body 9 has thickness greater than, or at least as great as, the total thickness of the three straps 3*a*–3*d* or 3*e*–3*h* in order to stop the movement of the straps 3*a*–3*h*.

A casing 12 is provided at the apertures 8 of the central strap 2. The casing 12 covers the coiled spring area of the rod member 10 and has a longitudinal hole through which the lever member 11 of the stopper device 6 is extended outward from the casing 12 for operation, as shown in FIGS. 1, 4 and 5*c*.

In FIG. 5*c*, which shows the position of the stopper device when the oval straps 3*a*–3*h* as well as the central strap 2 are operated to form a defensive covering structure for the head, the rectangular body is, by means of the coiled spring 13 inserted thereinto, and fitted thereto the rectangular through-hole 7 which is formed with the sum of the concaves disposed at the end of the oval straps 3*a*–3*h* as described above.

Figure 3:
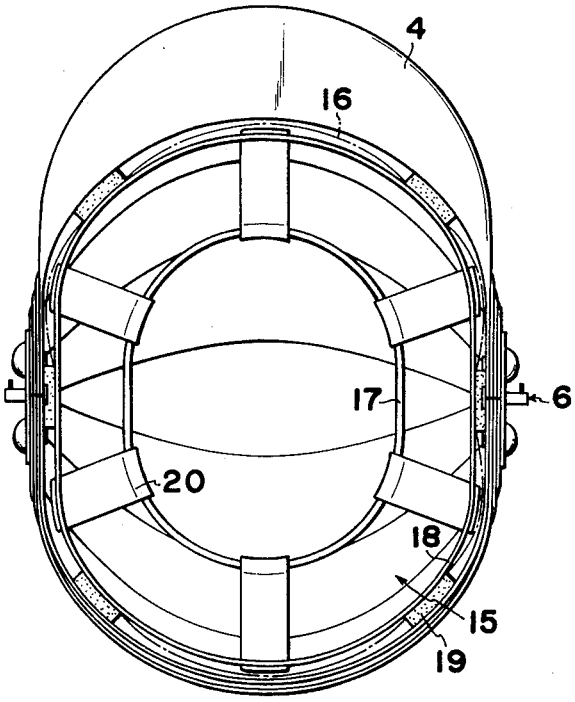
FIG. 3 is a bottom view of the helmet shown in FIG. 1.

As shown in FIGS. 2 and 3 there are provided lining materials 15, in a general form, such as an outer encircled string 16 which is slidably secured along the inside surface of the rim portion of the helmet, an inner encircled string 17, bands 20 which are radially disposed and resiliantly connect the string 16 with the string 17, an encircled belt 18 which is formed to fit around the wear's head, and a plurality of shock absorber members 19. The outer string 16, inner string 17, radially disposing bands 20, and the encircled belt 18 will take the form of a netlike skullcap. The lining materials 15 will not be described in further detail because conventional lining materials can be employed.

In such an arrangement, after the straps are pulled out in both directions as illustrated by the arrows in FIG. 5*a* until the downward projections 2', 3' are engaged with the upward projections 3'' as shown in FIG. 2 so as to form a defensive covering in the shape of a dome, the rod member 10 is pulled out by operating the lever member 11. Then the rectangular body 9 of the stopper device is pulled to the inside of the rectangular through-hole 7 by the force of the coiled spring 13. After the rectangular body 9 is snugly fitted in the through-hole 7, the lever member 11 is secured at a desired position of the hole of the casing by known methods so that the lever member 11 is locked. Thus, a defensive covering for the head, i.e. a helmet, is completely ready for wearing.

When the helmet is not used, the lever member 11 which has been locked is released to allow the rectangular body 9 to be removed out of the rectangular through-hole 7. After that, the oval straps 3*a*–3*h* are pushed toward the central strap 2, thereby collapsing or holding the oval straps adjacent to the inside space of the central strap 2. Thus, the helmet formed with plural pieces is folded into a single compact piece.

In a preferred stopper device 6' shown in FIGS. 6*a*–6*d*, discs 42 are provided at the inner ends of the straps 3*a*–3*h*. Each disc 42 has at its one side two pins 41*a* and 41*b* which extend through apertures 8' formed at the end portion of the central strap 2 between the two pivot pins 5*a* and 5*b* for the first and second groups of the straps. The pins 41*a* and 41*b* have respective outer ends connected to a plate spring 13' which in turn is connected at both ends thereof to the outer end surface of the central strap 2 in such a manner that the disc may be urged to the inner surface at the end of the central strap 2. The disc 42 has also two protrusion members 43*a* and 43*b* in a tapered shape as shown in FIGS. 6(*a*) and 6(*b*). Each of the straps 3*a*–3*h* has hole 7'*a* or 7'*b* at each end portion thereof, and the holes 7'*a* and 7'*b* in each group of the straps are formed such that they may be aligned or registered when the straps 3*a*–3*h* are fully pulled out. The tapered protrusion members 43*a* and 43*b* fixed on the disc 42 are provided in such a manner that they may normally be pressed slidably against the flat end portion of the strap 3*d* and 3*h* but be fitted into the aligned holes 7'*a* and 7'*b* when the straps are fully pulled out. The stopper 6' further comprises a covering 44 at the outer surface of the end portion of the central strap 2. The covering 44 is formed in a saucer shape and has hooks 45, thereby manually placing it at a predetermined position where associating slots 46 are formed on the central strap 2. Thus, when the straps 3*a*–3*h* are pulled out, the tapered protrusion members 43*a* and 43*b* slide across the inner flat surfaces of the straps 3*d* and 3*h* and are fitted in the aligned holes 7'*a* and 7'*b* by the action of the plate spring 13', thereby locking the pivoted straps 3*a*–3*h* in the pulledout position shown in FIGS. 1–4. When the helmet is not being used, the straps 3*a* through 3*h* can be collapsed or folded into a compact form by pulling the inner plate 42 toward the inner center of the helmet against the force of the plate-spring 13'. Namely, when the inner plate 42 is pulled by a fingertip operation against the force of the plate-spring 13', the tapered protrusion members 43*a* and 43*b*, which have been inserted into the aligned holes 7*a* and 7'*b* as described above, are taken out of the holes 7'*a* and 7'*b* to allow the straps 3*a* through 3*h* to become collapsible into a compact form.

Though the stopper device 6' has been described with respect to one end portion of the straps, a similar stopper (not shown) device of the same construction will be disposed at the other end portion of the straps.

Figure 7:
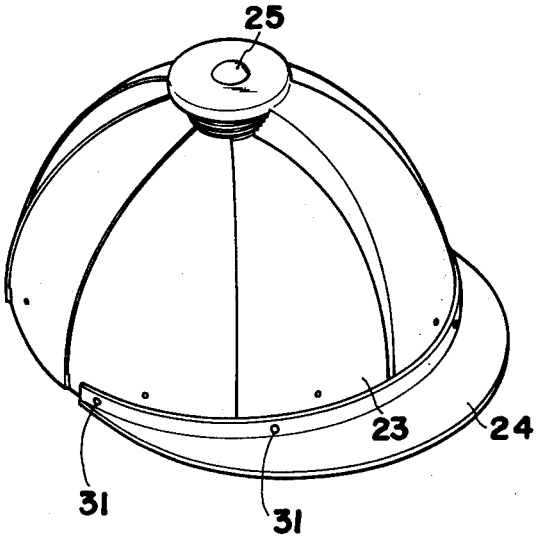
FIG. 7 is a perspective view of a helmet of a second embodiment of the present invention.
Figure 9:
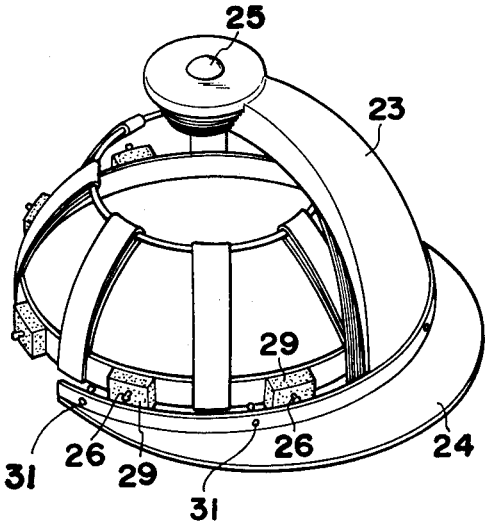
FIG. 9 is a perspective view with partly sectioned of the helmet shown in FIG. 7.
Figure 8:
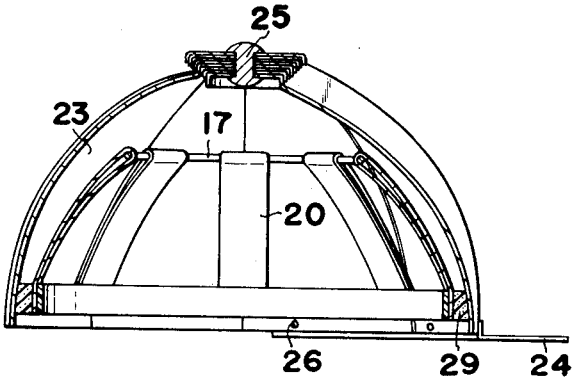
FIG. 8 is a sectioned view of the helmet shown in FIG. 7.
Figure 10:
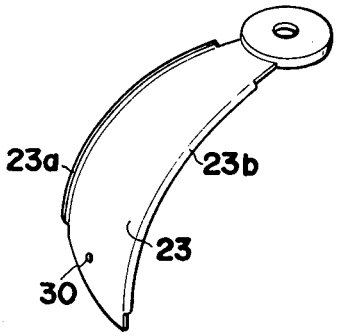
FIG. 10 is a perspective view of an unfolded fan shaped strap used for the second embodiment shown in FIG. 7.

In FIGS. 7 through 10, which show a second embodiment of the present invention, a plurality of fan shaped straps 23 made of aluminium alloy are pivotably secured by a pin 25 at the top end of the straps. Each of the straps has an upward extension 23*a* at one side thereof and a downward extension 23*b* at the other side thereof as shown in FIG. 10 so that the upward and downward extensions may connect the adjacent straps together. The helmet in this embodiment additionally has a plurality of clasping members 26 at predetermined intervals on a shock absorber member 29, which corresponds to the member 19 of the first embodiment, and a hole 30 at the flared end of the straps for associating with the corresponding crasping member 26, as shown in FIG. 9. When the fan-shaped straps 23 are pivoted about the pin 25 until the adjacent straps are engaged with each other by means of the upward extensions 23*a* and downward extensions 23*b*, a dome-shaped helmet will be formed as illustrated in FIG. 7. The clasping members 26 ensure the fixture of the straps in a desired dome-shaped configuration. A brim 24 is fixed to the flared end portion of the completed dome-shaped helmet by a desirable member as pins 31 or the like. In this embodiment, the fan-shaped straps 23 are slidably secured by the pin 25 which will be positioned at the summit of the helmet. Lining construction will not be described in detail here since it is similar with that of the first embodiment and moreover the conventional lining may be employed. The same reference numerals are put on the like ports with respect to the lining materials.

Figure 11:
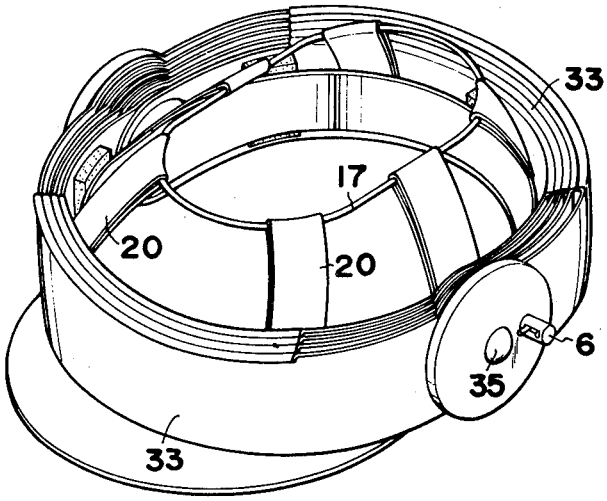
FIG. 11 is a perspective view of the helmet of another embodiment, showing that the helmet as collapsed into a compact form.

FIG. 11 shows another embodiment of the present invention, in which straps 33 have the same width along one end to the other, and a single pin 35 is provided at each end portion of the straps whereas the helmet of the first embodiment has two pins 5*a* and 5*b* at each end portion. Other constructions of the members such as upward and downward extensions of the straps, stopper device, lining materials, etc. are similar with those of the construction of the first embodiment described with reference to FIGS. 1 through 5*c*, and no detailed description will be made here since the construction will be clearly apparent from FIG. 11 as well as from the disclosure of the first embodiment of the present invention. As shown in FIG. 11, the straps 33 can be folded or collapsed into two opposite groups by pushing one of the straps with a finger to release the engagement between the upward extensions and the downward extensions. Since the straps are made of light metals, a fingertip pressure onto the downward extension portion of the predetermined strap can release the engagement between the straps.

In the present invention, the straps as well as brim, if required, may be made of duralumin or synthetic resins.

What is claimed is:

1. A defensive covering for the head comprising:

arc-shaped straps divided into two groups, said straps in one group having different radii of curvatures which become smaller in turn from the outer strap to the inner strap, and each of said straps having a width which becomes narrower toward the ends thereof;

two pivot means each provided at both ends of said straps in one group for pivotably connecting said straps in said group;

engaging means provided at the sides of each of said straps for engaging between the adjacent straps when said straps are expanded; and locking means provided at end portions of said two groups of said straps, said locking means being operable when said straps of said two groups are fully expanded.

2. A defensive covering for the head as claimed in claim 1, further comprising an arc-shaped central strap having a radius of curvature larger than any one of said straps and provided between said two groups of said straps, said locking means being provided at both ends of said central strap.

3. A defensive covering for the head as claimed in claim 2, wherein:

said locking means is comprised of:

a plate member, a spring means urging said plate member against the inner surface of said straps, and tapered protrusion members provided on the outer surface of said plate member;

the pivotable straps in each group have holes therein formed to be aligned when said straps are fully expanded; and said tapered protrusions of said lock means fitting into said aligned holes in said straps when said straps are expanded.

4. A defensive covering for the head as claimed in claim 2, wherein said central strap has a width substantially equal to the entire length thereof and is about twice as wide as each pivotable strap.

5. A defensive covering for the head comprising:

a plurality of arc-shaped straps for forming a bowl shaped configuration;

means for pivotably connecting said straps at at least one end of each of said straps, said straps being collapsible and expansible about said pivot means;

said straps having cut-out portions therein forming a rectangular opening when said straps are expanded about said pivot means;

means for engaging adjacent straps when said straps are expanded and for releasing the engagment when said straps are collapsed; and locking means adjacent said rectangular opening for engaging said rectangular opening and locking said straps in the expanded position, said locking means comprised of:

a rectangular body, a rod member vertically extending from the bottom of said rectangular body and turnable about its axis, a lever member vertically extending from the end portion of said rod member, and a coiled spring disposed around said rod member between said rectangular body and said lever member, whereby when said rectangular opening is formed when said arc-shaped straps are expanded, said rectangular body is inserted into said rectangular hole to keep said arc-shaped straps expanded.

* * * * *